US005539037A

United States Patent [19]

Iqbal

[11] Patent Number: 5,539,037

[45] Date of Patent: Jul. 23, 1996

[54] SPANDEX CONTAINING CERTAIN ALKALI METAL SALTS

[75] Inventor: Tahir Iqbal, Waynesboro, Va.

[73] Assignee: E. I. Du Pont de Nemours and Company, Wilmington, Del.

[21] Appl. No.: 128,431

[22] Filed: Sep. 30, 1993

[51] Int. Cl.[6] ..... C08K 5/09; D06M 13/188; D06M 13/224; D06M 13/248

[52] U.S. Cl. ..... 524/394; 8/115.51; 8/115.54; 8/115.64; 8/115.68; 524/395; 524/420; 524/590; 524/773; 524/775; 524/777; 524/871; 528/906

[58] Field of Search ..... 528/906; 524/394, 524/395, 420, 590, 773, 775, 777, 871; 8/115.51, 115.54, 115.64, 115.68

[56] References Cited

U.S. PATENT DOCUMENTS

| | | | |
|---|---|---|---|
| 3,624,179 | 11/1971 | Carroll | 524/115 |
| 4,296,174 | 10/1981 | Hanzel et al. | 428/389 |
| 4,340,527 | 7/1982 | Martin | 524/432 |
| 4,973,647 | 11/1990 | Bretches et al. | 528/61 |
| 5,000,899 | 5/1991 | Dreibelbis et al. | 264/205 |
| 5,086,150 | 2/1992 | Frauendore et al. | 528/49 |

FOREIGN PATENT DOCUMENTS

| | | |
|---|---|---|
| 4814198 | 5/1973 | Japan . |

*Primary Examiner*—James J. Seidleck
*Assistant Examiner*—Rabon Sergent

[57] ABSTRACT

An alkali metal salt additive in very low concentration in spandex (e.g., 0.02–0.25%) increases the heat set efficiency of spandex. The anion of the salt is a carboxylate having 1 to 10 carbon atoms or thiocyanate.

6 Claims, No Drawings

SPANDEX CONTAINING CERTAIN ALKALI METAL SALTS

BACKGROUND OF THE INVENTION

1. Field of the Invention

The present invention relates to a spandex that contains an alkali metal salt. More particularly, the invention concerns such a spandex in which a very low concentration of particular alkali metal salt additives improve the heat set efficiency of the spandex.

2. Description of the Prior Art

Spandex is a manufactured fiber in which the fiber-forming substance is a long chain synthetic elastomer comprised of at least 85% by weight of a segmented polyurethane. Spandex is conventionally wet spun or dry spun from polymer that is made, for example, by reacting a relatively high molecular weight dihydroxy compound (e.g., a polyether glycol) with an organic diisocyanate to provide a capped glycol which is then chain-extended with diamine to form the elastomer.

Spandex has proven to be useful in various commercial yarns and fabrics, especially when used in combination with various non-elastic yarns. Fabrics or yarns which contain spandex and non-elastic fibers, typically are heat set to provide the fabric or yarn with satisfactory dimensional stability, without detrimentally affecting the mechanical properties of the spandex and non-elastic fibers. Typical heat setting temperatures in commercial operations are 195° C. for 6,6-nylon, 190° C. for 6-nylon, and 180° C. for cotton. After heat setting the fabrics or yarns usually are subjected to further treatment in boiling water during scouring and dyeing operations.

In the past, certain chemical modifications to the polymer chain of the spandex have been suggested to improve the heat-set characteristics of the spandex. For example, Dreibelbis et al, U.S. Pat. No. 5,000,899, and Bretches et al, U.S. Pat. No. 4,973,647, each disclose heat set efficiency being improved by incorporating particular diamine chain extender mixtures in the spandex polymer. However, further improvements in heat setting properties are desired. A spandex that could be heat set at lower temperatures or with shorter residence times would have significantly increased utility. Accordingly, an aim of this invention is to further improve the heat set efficiency of a spandex without detrimentally affecting the elastic and tensile properties of the spandex.

Spandex containing relatively high concentrations of certain alkali metal salts of particular organic and inorganic acids have been disclosed in the art, for example, by Frauendorf et al, U.S. Pat. No. 5,086,150, Japanese Patent Application No. Sho 48-14198 and Hanzel et al, U.S. Pat. No. 4,296,174. However, such disclosures are not concerned with the heat set properties of spandex and do not specifically disclose the use of alkali metal salts at very low concentrations, as in the present invention.

SUMMARY OF THE INVENTION

The present invention provides a spandex that contains an alkali metal salt in an amount effective for increasing the heat set efficiency of the spandex. The salt has an alkali metal cation, which preferably is lithium, sodium or potassium, and an anion, which is a carboxylate having 1 to 10 carbon atoms or thiocyanate. Typically, the salt is effective in amounts of as little as 0.02 percent by weight of the spandex polymer and does not exceed 0.25%, preferably 0.03 to 0.09%. When the anion is derived from thiocyanic acid or an aliphatic monocarboxylic acid of the formula $R^1$-COOH, wherein $R^1$ is a linear saturated chain of 1 to 7 carbon atoms, the effective amount of the salt is less than 0.1%. When the carboxylate anion is derived from aromatic monocarboxylic acid of the formula $R^3$—$R^2$—$R^4$—COOH, wherein $R^2$ is a benzene ring, $R^3$ is hydrogen chlorine, bromine or lower alkyl, (e.g., of 1 to 4 carbon atoms), and $R^4$ which is an optional group, is methylene (—$CH_2$—), ethylene (—$CH_2$—$CH_2$—) or vinylene (—CH=CH—), the effective amount of the salt preferably is no more than 0.2%. Preferred anions include benzoate, acetate, cinnamate, and chlorobenzoate.

DETAILED DESCRIPTION OF PREFERRED EMBODIMENTS

For convenience, in the discussion and examples that follow, certain terms may be abbreviated as follows:

| | |
|---|---|
| poly(tetramethyleneether)glycol | PO4G |
| methylene-bis(4-phenylisocyanate) | MDI |
| isocyanate end group | NCO |
| ethylene diamine | EDA |
| 2-methyl-1,5-diaminopentane | MPMD |
| N,N-dimethylacetamide solvent | DMAc |
| copolymer of a 75/25 weight ratio of diisopropylaminoethyl methacrylate and decyl acrylate | DIPAM/DM |
| "Cyanox" 1790 antioxidant, 2,4,6-tris-(2,6-dimethyl-4-t-butyl-3-hydroxybenzyl)-isocyanurate sold by American Cyanamid | "Cyanox" |
| Tenacity, dN/tex | T |
| Elongation at break, % | E |
| Load power on first cycle, dN/tex | |
| at 100% elongation | LP100 |
| at 200% elongation | LP200 |
| Unload power on fifth cycle, dN/tex | |
| at 100% elongation | UP100 |
| at 200% elongation | UP200 |
| % Set | % S |
| Heat set efficiency, % | HSE |

In accordance with the present invention, the addition of very small amounts of an alkali metal salt to the polymer of a spandex is surprisingly effective in improving the heat set characteristics of the spandex. The particular salts that are suitable for use in the present invention are alkali metal salts of certain monocarboxylic acids or of thiocyanic acid. Preferred alkali metals are lithium, sodium and potassium. These form the cation of the salt. Suitable anions of the salt are carboxylates or thiocyanates.

Carboxylate anions according to the invention have 1 to 10 carbon atoms. The carboxylate can be derived from an aliphatic monocarboxylic acid of the formula $$R^1\text{—COOH} \quad (I)$$

wherein $R^1$ is hydrogen or a chain of carbon atoms, preferably numbering in the range of 1 to 7 carbon atoms. The $R^1$ chain of carbon atoms may be saturated or unsaturated and linear or branched. Preferably, $R^1$ is linear but may have minor amounts of substituents, such as lower alkyl, chlorine, fluorine and the like. A most preferred aliphatic monocarboxylic acid is acetic acid. The carboxylate can be derived from aromatic monocarboxylic acids as well. Such aromatic carboxylic acids are of the formula $$R^3—R^2—R^4—COOH \quad (II)$$

wherein $R^2$ is a benzene ring, $R^3$ is hydrogen, chlorine, bromine or lower alkyl of 1–4 carbon atoms, and $R^4$ is optional. When present, $R^4$ is methylene (—$CH_2$—), ethylene (—$CH_2$—$CH_2$—) or vinylene (—CH=CH—) group. Preferred anions derived from aromatic monocarboxylic acids include benzoate, cinnamate and chlorobenzoate.

Typically, the salt additive is effective in improving the heat setting characteristics of the spandex when the salt amounts to as little as 0.02 to 0.25% by weight of the polymer of the spandex. When the anion is thiocyanate or derived from an aliphatic monocarboxylic acid, the effective amount of the salt is less than 0.1%. When the carboxylate anion is derived from an aromatic monocarboxylic acid the effective amount of the salt preferably is no more than 0.2%. For large improvements in heat set efficiency, a salt of an alkali metal benzoate, especially potassium benzoate, is particularly preferred at a concentration in the range of 0.03 to 0.09%, based on the weight of the spandex polymer.

The alkali metal salt additive can be incorporated into the filaments in the same manner as other conventional spandex additives.

Conventional polymers used for preparing spandex by dry spinning are suitable for the spandex of the present invention. The polymers typically are prepared by known processes in which a high molecular weight dihydroxy polymer (e.g., a polyether-based glycol, a polyester-based glycol, a polycarbonate-based glycol) is reacted with a diisocyanate to form an isocyanate-capped glycol which is then reacted with diamine chain extender to form segmented polyurethane polymer. Usually, the polymer is dissolved in an inert organic solvent, such as dimethylacetamide (DMAc), dimethylformamide, or N-methyl pyrrolidone and then the polymer solution is dry-spun in conventional equipment through orifices to form filaments.

The polymer of the spandex of the invention can contain conventional agents that are added for specific purposes, such as antioxidants, thermal stabilizers, UV stabilizers, pigments, dyes, lubricating agents and the like. Titanium dioxide delusterant also is commonly added. Such agents usually are added to the solution of the polymer and become incorporated into the filaments during the dry spinning step; some can be applied as a finish on the spandex surface.

The following test procedures are used in the Examples for measuring various characteristics of the spandex fibers.

Heat set efficiency is measured on a spandex sample that is stretched to one-and-a-half times its original length and then while stretched is heated in an oven at 190° C. for 100 seconds. As part of the treatment, the sample then is relaxed and allowed to reach room temperature, after which the sample is immersed in boiling water for 30 minutes, removed from the water and allowed to dry at room temperature. The heat set efficiency is calculated in percent as $$\% \ HSE=100(L_s-L_o)/(1.5L_o-L_o)=200(L_s-L_o)/L_o$$

where $L_o$ and $L_s$ are respectively the sample length, when held straight without tension, before and after the heat setting treatment.

The HSE advantage of a spandex that contains an alkali metal salt according to the invention over an identical spandex except that the salt is absent (i.e., a comparison sample), is the percentage point difference between the HSE of the spandex of the invention and that of the comparison. A salt additive is considered to be effective for the purposes of the invention, when the salt additive improves the heat set efficiency of the spandex at 190° C. by at least five percentage points (in comparison to the same spandex containing no salt).

Strength and elastic properties of the spandex are measured in accordance with the general method of ASTM D 2731-72. Three filaments, a 2-inch (5-cm) gauge length and a zero-to-300% elongation cycle are used for each of the measurements. The samples are cycled five times at a constant elongation rate of 800% per minute and then held at the 300% extension for half a minute after the fifth extension. "Load power" is reported herein in deciNewtons/tex and is the stress measured at a given extension during the first load cycle. "Unload Power" is reported herein in deciNewtons/tex and is the stress measured at a given extension during the fifth unload cycle. Percent elongation at break is measured on the sixth extension cycle. Percent set is measured on samples that have been subjected to five 0–300% elongation-and-relaxation cycles. The percent set ("% S") is then calculated as $\% \ S=100(L_f-L_o)/L_o$, where $L_o$ and $L_f$ are respectively the filament length, when held straight without tension, before and after the five elongation/relaxation cycles.

EXAMPLES

The following examples describe preferred embodiments of the invention. The examples are for illustrative purposes and are not intended to limit the scope of the invention; the scope is defined by the appended claims. The results reported in these examples are believed to be representative but do not constitute all the runs involving the indicated ingredients. Unless otherwise stated, all percentages are by weight of the polymer of the spandex. In the examples, samples of the invention are designated with Arabic numerals and comparison samples are designated with upper case letters.

Each of the spandex samples of the invention described in the examples was prepared from a polymer, to which various alkali metal salts were added. For comparison samples, the salt was omitted. The polymer for each spandex sample was made from capped glycol, which was the reaction product of MDI and PO4G of 1800 number average molecular, prepared with a capping ratio (i.e., the molar ratio of MDI to PO4G) of 1.63 and having an NCO content of 2.40%. The capped glycol was dissolved in DMAc and then chain extended with a 90/10 diamine mixture of EDA/MPMD. DEA was employed as a chain terminator. The dissolved polymer provided a solution having 36.8% solids. Additives amounting to 1.5% "Cyanox"-1790 antioxidant, 2% DIPAM/DM and 0.6% silicone oil, based on the weight of the polymer, were added to the solution. In addition a concentrated solution or slurry of alkali metal salt in DMAc was thoroughly mixed with the polymer solution to provide the desired concentration of salt in the polymer.

The solution described in the preceding paragraph was dry spun into 4-coalesced-filament 44-dtex yarns in a conventional apparatus. The coalesced multi-filament threadlines then were wound up. For each sample containing an alkali metal salt, the same polymer without the salt was spun and wound up at the same speed in the above-described manner to form a comparison sample.

Example I

This example illustrates the advantageous effects on the heat set efficiency of spandex achieved by incorporating in the spandex small concentrations of potassium benzoate in accordance with the invention. The example also demonstrates that, over the concentration range of interest, the salt affects the tensile and elastic properties of the as-spun spandex very little. The as-spun properties are shown to compare quite favorably with those of a commercial spandex (Sample X) made of the same polymer with the same additives as the samples of the example, except for the salt which was not present in the commercial spandex. Potassium benzoate is an alkali metal salt of an organic monocarboxylic acid. Table I summarizes the measurements made on the samples prepared. Note that in this example, spandex to which no potassium benzoate was added had a heat set efficiency of 72.2%. Comparison Samples A and B which contained potassium benzoate in a concentration of only 0.01 and 0.02 % respectively, also showed no improvement in heat set efficiency. In contrast, Samples 1 and 2, respectively containing 0.04 and 0.12% of potassium benzoate had heat set efficiencies of 80.6 and 90.0%. These correspond to heat set efficiency advantages of 8.4 and 17.8 percentage points respectively.

TABLE I (Example I)

| Sample | X | A | B | 1 | 2 |
|---|---|---|---|---|---|
| % Salt | 0 | 0.01 | 0.02 | 0.04 | 0.12 |
| E, % | 460 | 420 | 440 | 410 | 430 |
| T, dN/tex | 0.91 | 0.99 | 1.02 | 0.99 | 1.02 |
| % Set | 18 | 15 | 16 | 16 | 15 |
| Power, dN/tex | | | | | |
| LP100 | 0.071 | 0.057 | 0.062 | 0.055 | 0.060 |
| LP200 | 0.16 | 0.15 | 0.16 | 0.15 | 0.16 |
| UP100 | 0.018 | 0.017 | 0.016 | 0.015 | 0.017 |
| UP200 | 0.029 | 0.027 | 0.027 | 0.027 | 0.029 |
| Heat Set Efficiency | | | | | |
| % HSE | 72.2 | 72.2 | 72.0 | 80.6 | 90.0 |
| HSE Advantage | 0 | 0 | −0.2 | +8.4 | +17.8 |

Example II

Example I was repeated with additional alkali metal salts of aromatic monocarboxylic acids in accordance with the invention. This example further demonstrates the advantageous effects on spandex heat set efficiency that result from incorporating such salts into spandex. Samples 3 and 4 contain lithium benzoate; Samples 5 and 6, sodium benzoate; Samples 7, 8 and 9, lithium cinnamate; and Samples 10 and 11, lithium chlorobenzoate. As in Example I, as-spun tensile and elastic properties of the spandex samples of the invention were little affected by the presence of the incorporated alkali metal salt. Table II summarizes the heat set efficiency advantage over comparison samples prepared the same way but without any alkali metal salt added thereto.

TABLE II (Example II)

| Sample | Alkali Metal Salt | Concentration Weight % | % HSE Advantage |
|---|---|---|---|
| 3 | Lithium benzoate | 0.055 | 13.3 |
| 4 | " | 0.110 | 16.5 |
| 5 | Sodium benzoate | 0.031 | 8.0 |
| 6 | " | 0.062 | 12.4 |
| 7 | Lithium cinnamate | 0.057 | 8.1 |
| 8 | " | 0.066 | 14.9 |
| 9 | " | 0.13 | 19.3 |
| 10 | Lithium chlorobenzoate | 0.07 | 8.9 |
| 11 | " | 0.14 | 16.8 |

Example III

Example II was repeated with alkali metal salts of an aliphatic monocarboxylic acid being incorporated into the spandex in accordance with the invention. In particular lithium acetate, potassium acetate, and sodium acetate were added to the polymer in the concentrations indicated in the table below. The presence of each of these salts in the spandex provided significant advantages in heat set efficiency over the same spandex without any such salt having been incorporated therein.

TABLE III (Example III)

| Sample | Alkali Metal Salt | Concentration Weight % | % HSE Advantage |
|---|---|---|---|
| 12 | Lithium acetate | 0.078 | 13.0 |
| 13 | Potassium acetate | 0.076 | 18.0 |
| 14 | Sodium acetate | 0.063 | 8.0 |

Example IV

Example II was repeated with sodium thiocyanate (an alkali metal salt of thiocyanic acid) being incorporated into the spandex in accordance with the invention at a concentration of 0.092%. The presence of the salt in the spandex resulted in a 7 percentage point advantage in heat set efficiency over the same spandex without any such salt having been incorporated therein.

Additional Comparison Samples Not of the Invention

Example II was repeated with the following salt additives, not of the invention, at the concentrations indicated. These salts had detrimental effects, or at best, provided inadequate improvements, in the heat set efficiency of the spandex.

| Salt | Concentration range, % |
|---|---|
| Ammonium benzoate | 0.040–0.230 |
| Lithium chloride | 0.056–0.075 |
| Lithium nitrate | 0.240–0.360 |
| Lithium phosphate | 0.145–0.553 |
| Lithium citrate | 0.035–0.150 |
| Lithium sulfate | 0.021–0.079 |
| Lithium silicate | 0.017–0.068 |
| Lithium 4-chlorobenzenesulfonate | 0.085 |
| Calcium lactate | 0.25–0.50 |
| Aluminum acetylacetonate | 0.11–0.22 |

I claim:

1. A spandex containing a salt additive in a concentration effective for increasing the heat set efficiency of the spandex, the concentration being in the range of 0.03 to 0.25 percent based on the weight of the polymer of the spandex, the salt additive having an alkali metal cation selected from the group consisting of lithium, sodium and potassium, and a carboxylate anion having 1 to 10 carbon atoms and being derived from an aromatic monocarboxylic acid of the formula $R^3$—$R^2$—$R^4$—COOH, wherein $R^2$ is a benzene ring, $R^3$ is hydrogen, chlorine, bromine or a lower alkyl of 1 to 4 carbon atoms, and $R^4$ is optional and when present is —$CH_2$—, —$CH_2$—$CH_2$—, or —CH=CH—.

2. A spandex in accordance with claim 1 wherein the anion is cinnamate, benzoate or chlorobenzoate and the effective amount of the salt is no more than 0.2% by weight of the spandex.

3. A spandex in accordance with claim 2 wherein the additive is potassium benzoate, lithium benzoate, sodium benzoate, lithium chlorobenzoate or lithium cinnamate.

4. A spandex containing a salt additive in a concentration effective for increasing the heat set efficiency of the spandex, the concentration being in the range of 0.03 to less than 0.1 percent by weight of the polymer of the spandex, the salt additive having an alkali metal cation selected from the group consisting of lithium, sodium and potassium, and an anion derived from thiocyanic acid or an aliphatic monocarboxylic acid of the formula $R^1$—COOH, wherein $R^1$ is a linear saturated chain of 1 to 7 carbon atoms.

5. A spandex in accordance with claim 4 wherein the anion is acetate.

6. A spandex in accordance with any preceding claim wherein the concentration of the salt is in the range of 0.03 to 0.09 weight % based on the weight of the polymer of the spandex.

* * * * *